US005444946A

United States Patent [19]

Zeigler

[11] Patent Number: 5,444,946

[45] **Date of Patent: * Aug. 29, 1995**

[54] PORTABLE SHELTER ASSEMBLIES

[75] Inventor: Theodore R. Zeigler, Alexandria, Va.

[73] Assignee: World Shelters, Inc., Alexandria, Va.

[ * ] Notice: The portion of the term of this patent subsequent to Jul. 27, 2010 has been disclaimed.

[21] Appl. No.: 156,695

[22] Filed: Nov. 24, 1993

[51] Int. Cl.[6] ..... E04H 12/18

[52] U.S. Cl. ..... 52/86; 52/81.3; 52/108; 52/646; 135/122; 135/147

[58] Field of Search ..... 52/81.3, 86 OR, 108, 52/109, 80, 222, 645, 646, 610; 135/87, 122, 123, 128, 147

[56] References Cited

U.S. PATENT DOCUMENTS

| | | | |
|---|---|---|---|
| Re. 33,710 | 10/1991 | Zeigler . | |
| 39,721 | 9/1863 | Cross . | |
| 101,165 | 3/1870 | Rodgers . | |
| 402,755 | 5/1889 | Lyon . | |
| 538,093 | 4/1895 | Weston . | |
| 607,933 | 7/1898 | Laird . | |
| 609,553 | 8/1898 | Lloyd . | |
| 931,529 | 8/1909 | Vaghi . | |
| 1,177,949 | 4/1916 | Homme . | |
| 1,376,937 | 5/1921 | Herviev et al. . | |
| 1,819,490 | 8/1931 | Weiss . | |
| 2,711,181 | 6/1955 | Woods . | |
| 2,962,034 | 11/1960 | Finlayson . | |
| 3,059,658 | 10/1962 | Finlayson . | |
| 3,375,624 | 4/1968 | Mikulin . | |
| 3,496,686 | 2/1970 | Bird . | |
| 3,559,353 | 2/1971 | Partridge . | |
| 3,710,806 | 1/1973 | Kelly et al. . | |
| 3,766,932 | 10/1973 | Sidis et al. . | |
| 3,773,061 | 11/1973 | Berger . | |
| 3,830,031 | 8/1974 | Soisson . | |
| 3,889,433 | 6/1975 | Eurbank, Jr. . | |
| 3,968,808 | 7/1976 | Zeigler . | |
| 4,026,313 | 5/1977 | Zeigler . | |
| 4,074,477 | 2/1978 | Runyon . | |
| 4,156,433 | 12/1980 | Rothe . | |
| 4,241,746 | 12/1980 | Rothe . | |
| 4,253,284 | 3/1981 | Bliss . | |
| 4,276,726 | 7/1981 | Derus | 52/109 |
| 4,280,521 | 7/1981 | Zeigler . | |
| 4,290,244 | 9/1981 | Zeigler . | |
| 4,393,887 | 7/1983 | Orobin . | |
| 4,437,275 | 3/1984 | Zeigler . | |
| 4,473,986 | 10/1984 | Zeigler . | |
| 4,527,362 | 7/1985 | Tobey et al. | 52/71 |
| 4,580,375 | 4/1986 | Nodskov et al. . | |
| 4,599,832 | 7/1986 | Benton | 52/118 |
| 4,607,656 | 8/1986 | Carter . | |
| 4,658,560 | 4/1987 | Beaulieu | 52/646 |
| 4,663,899 | 5/1987 | Nodskov et al. | 52/109 |
| 4,689,932 | 9/1987 | Zeigler . | |
| 4,745,725 | 5/1988 | Onoda . | |
| 4,761,929 | 8/1988 | Zeigler . | |
| 4,838,003 | 6/1989 | Zeigler . | |
| 5,014,484 | 5/1991 | Tanizawa et al. | 52/646 |
| 5,036,641 | 8/1991 | Viry | 52/646 |
| 5,230,196 | 7/1993 | Zeigler . | |

*Primary Examiner*—Carl D. Friedman
*Assistant Examiner*—Wynn E. Wood
*Attorney, Agent, or Firm*—Burns, Doane, Swecker & Mathis

[57] ABSTRACT

An expandable and collapsible shelter is formed from a series of interconnected expandable and collapsible modules. Each module is formed from interconnected strut pairs pivotably attached at their ends to hub assemblies. The hub assemblies have outer and inner portions that are engageable and disengageable. A pair of struts is placed in a desired angular relationship by a first member for constraining a range of movement of the outer portions of the hub assemblies relative to one another and a releasable member for releasably constraining a range of movement of the inner portions of the hub assemblies relative to one another.

40 Claims, 10 Drawing Sheets

FIG. 1A
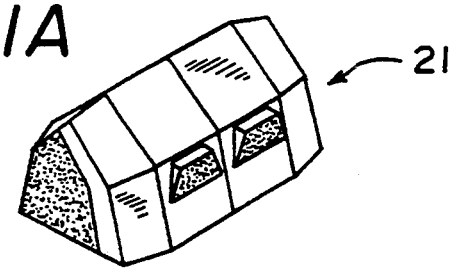
FIG. 1B
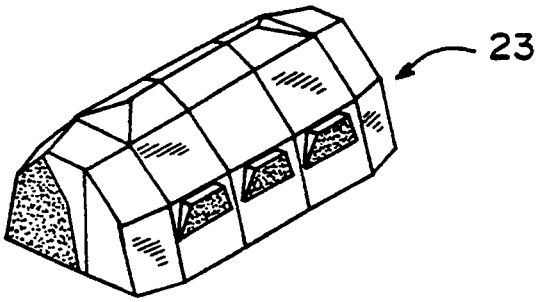
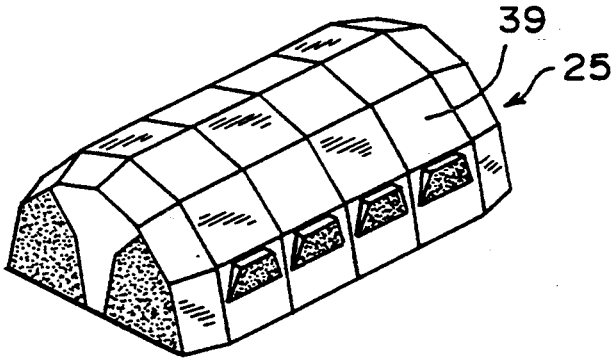
FIG. 1C
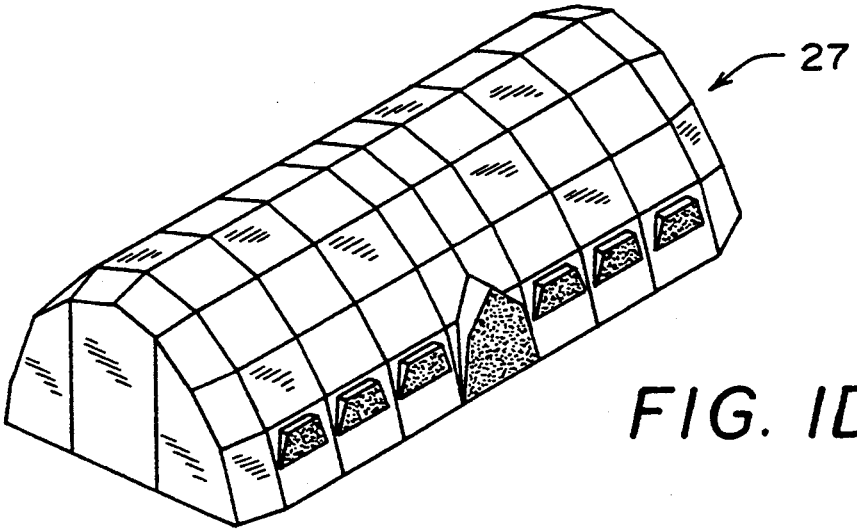
FIG. 1D

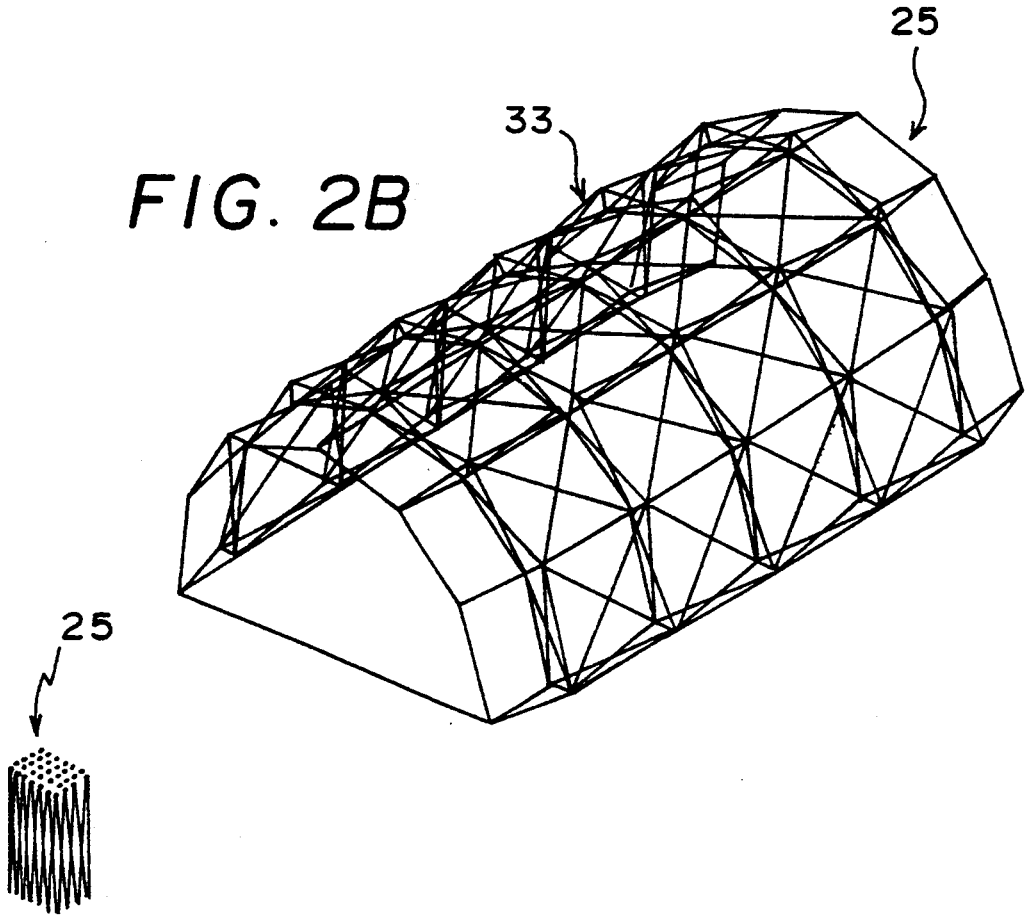
FIG. 2B
FIG. 2A
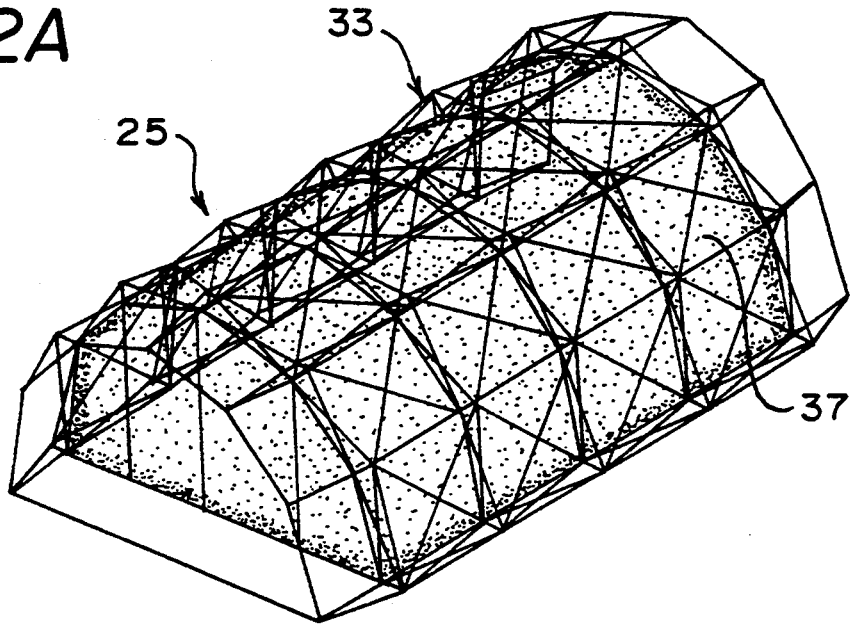
FIG. 2C

FIG. 8A
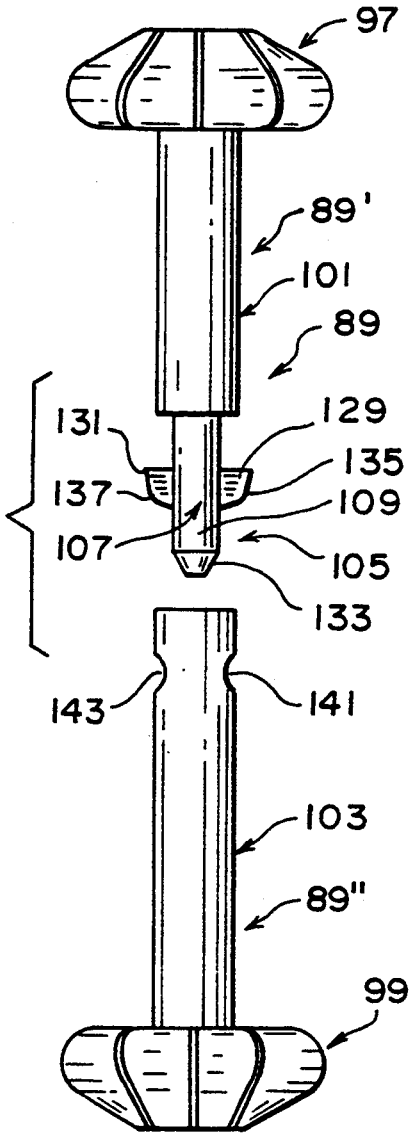
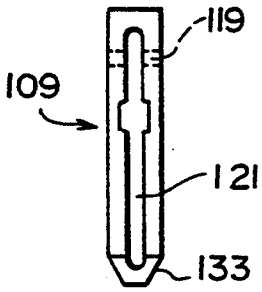
FIG. 8C
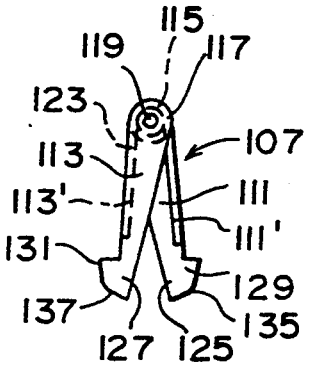
FIG. 8D
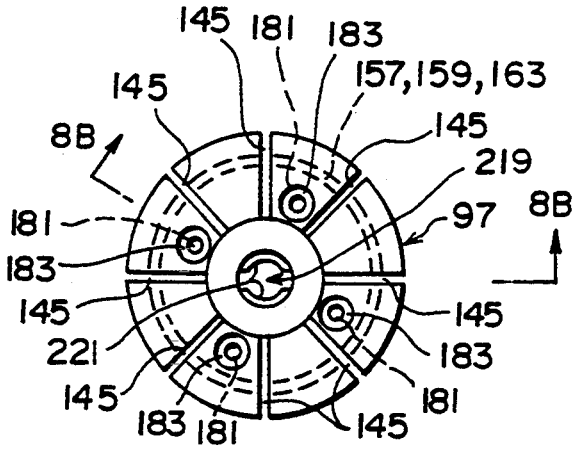
FIG. 8E
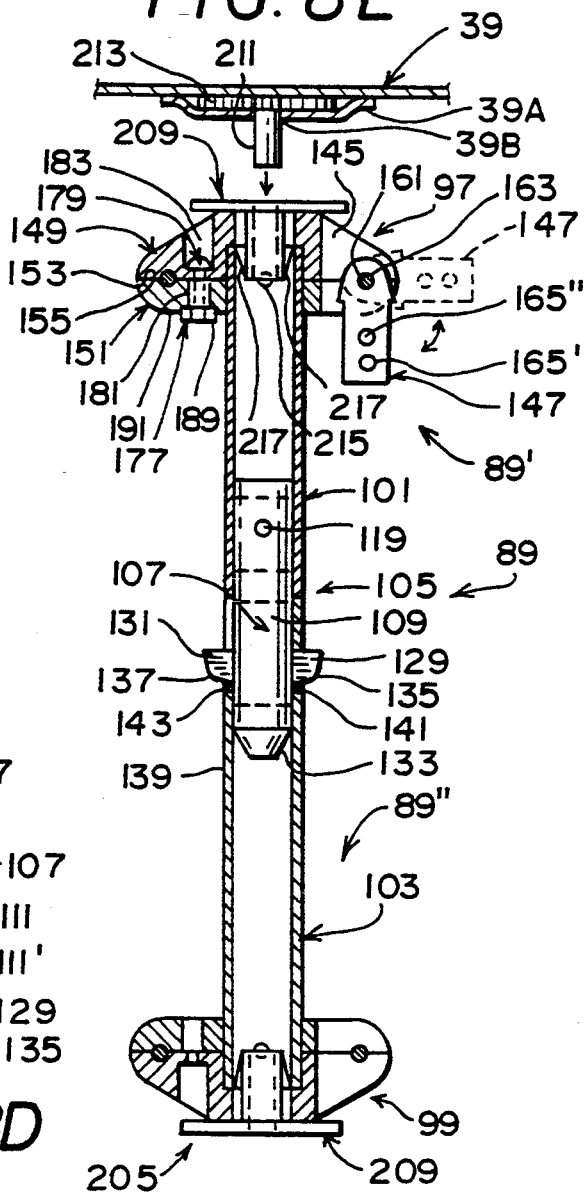
FIG. 8B

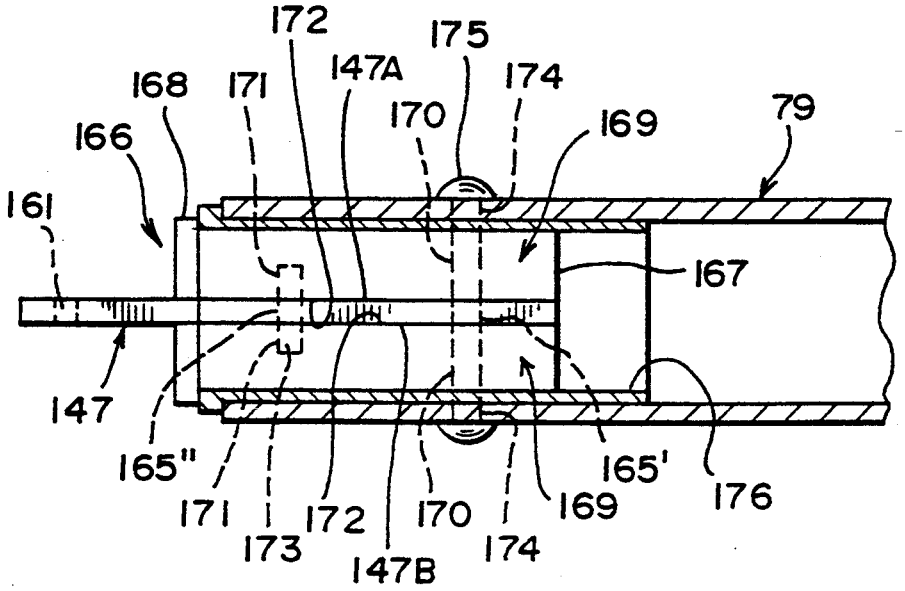
FIG. 8H
FIG. 8I
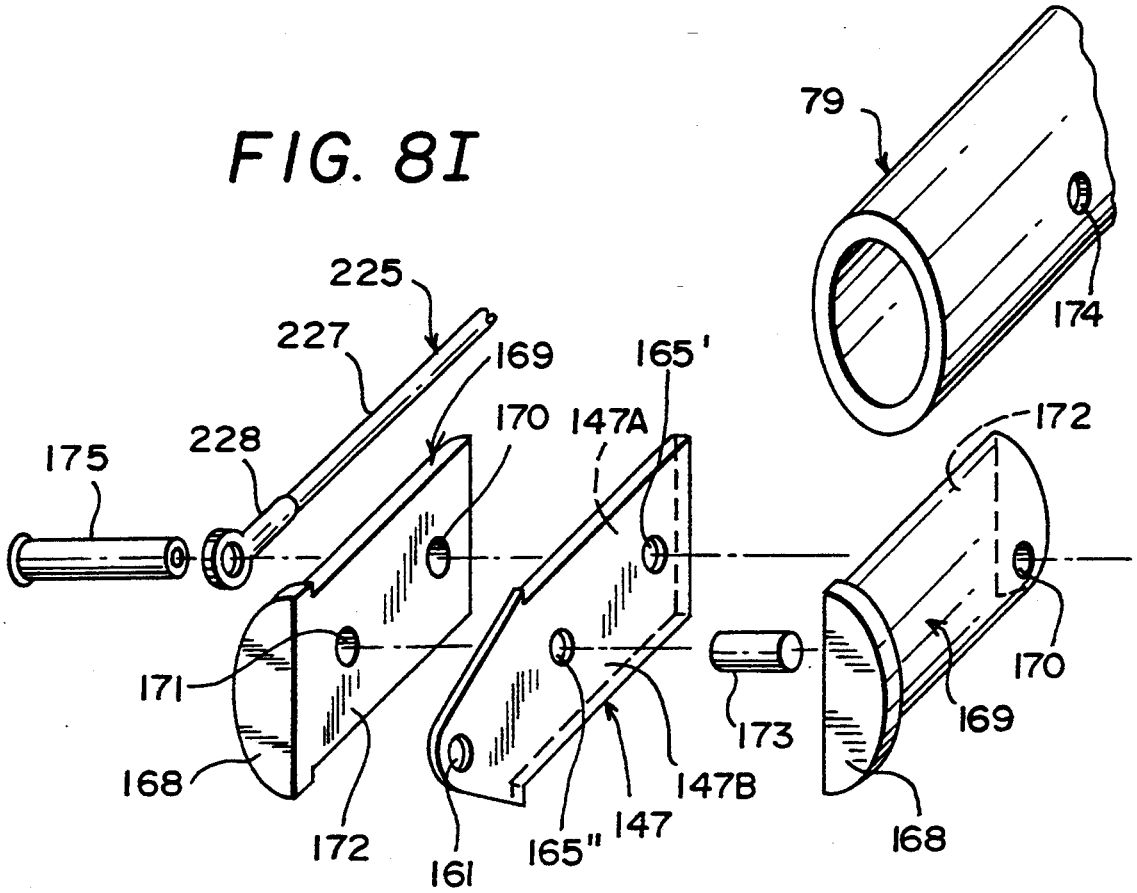

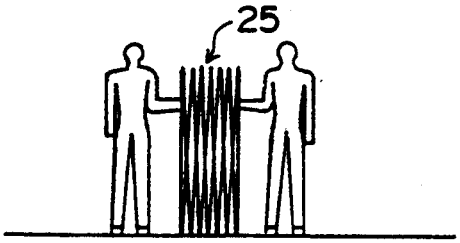
FIG. 10A
FIG. 10B
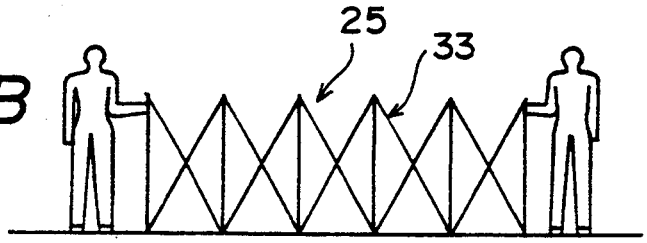
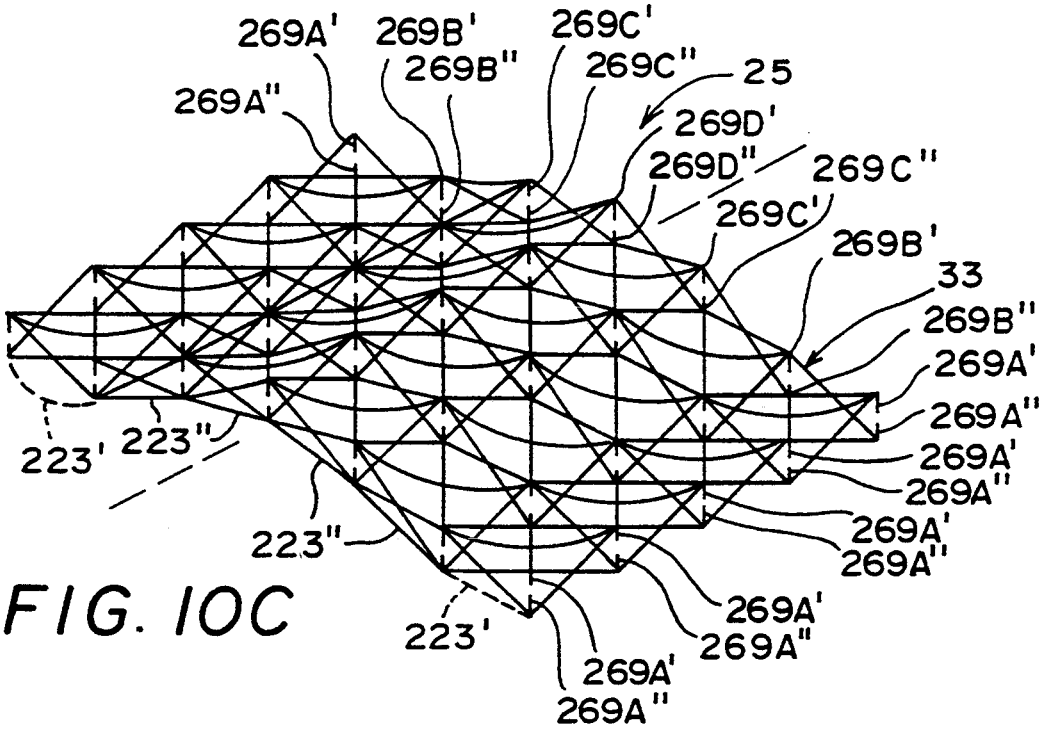
FIG. 10C
FIG. 10D
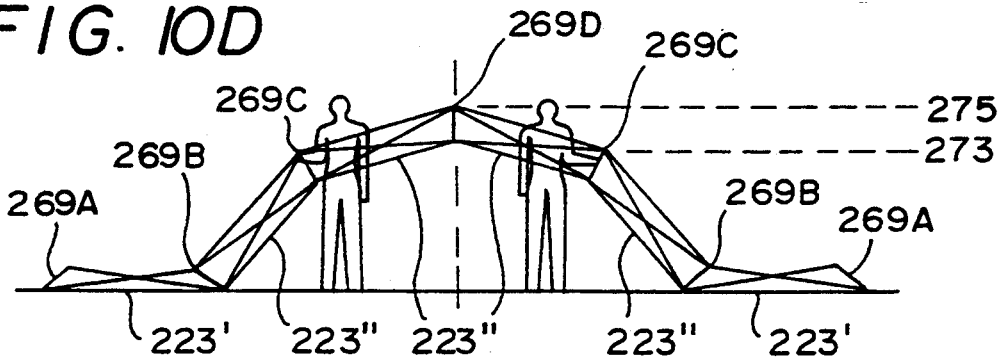

PORTABLE SHELTER ASSEMBLIES

BACKGROUND

This invention relates to portable shelter assemblies and, more particularly, to collapsible and expandable portable shelter assemblies.

In my prior U.S. Pat. Nos. 3,968,808, 4,026,313, 4,290,244, 4,437,275, U.S. Pat. No. Re. 33,710, and U.S. Pat. No. 5,230,196 I have disclosed interconnected pentagonal, hexagonal, rectangular, or square sections or modules for forming collapsible and expandable portable shelters. The shelters formed by these modules are light in weight and adapted to be quickly put up and taken down. The modules and shelters formed from the modules disclosed in, for example, my U.S. Pat. Nos. 3,968,808 and U.S. Pat. No. Re. 33,710 are self-supporting by virtue of a self-locking action resulting from the asymmetrical disposition of certain strut members forming the modules. While the self-locking aspect of these shelters is highly advantageous in facilitating the fast and simple erection of such shelters, it is desirable to provide a shelter having greater resistance to adverse conditions, such as wind or snow, which tend to create stresses in the structures.

My U.S. Pat. No. 5,230,196 provides a system including modules formed of pivotably pinned pairs of struts arranged on the sides of the modules. The strut pairs are pivotably attached to engageable and disengageable locking devices defining corners of the modules. When the locking devices are disengaged, the modules are adapted to fold into a bundle. When the modules are unfolded, the locking devices are manually engaged to form the expanded modules. The expanded modules including manually engaged locking devices exhibit enhanced resistance to stress-inducing conditions.

It is desirable to provide collapsible and expandable modules for forming portable shelters that are light in weight, and that exhibit great resistance to stress-inducing conditions. It is further desirable to provide expandable and collapsible modules for forming portable shelters that are adapted to be quickly put up at a site without tools, and are adapted to be put up by workers at ground level, without the need for ladders, or other similar equipment. It is further desirable to provide a portable shelter that is easy to store and transport. It is further desirable to provide a set of expandable and collapsible modules that are adapted to be combined in a variety of ways to form a variety of different types of portable shelters. It is still further desirable to provide expandable and collapsible modules for forming self-supporting portable shelters requiring no internal obstructions. It is still further desirable to provide expandable and collapsible modules of one or more types that possess sufficient strength to be combined with one another to form various types and sizes of portable shelters.

SUMMARY

In accordance with one aspect of the present invention, an expandable and collapsible scissor assembly for an expandable and collapsible structure is provided. The scissor assembly includes a first strut having a first and a second end, a second strut having a first and a second end, and means for limiting the first and second ends of the first and second struts to movement in a substantially common plane, the first and second struts overlying each other at a point in the plane. First means are provided for preventing movement of the first end of the first strut away from the second end of the second strut beyond a first expanded distance. Releasable means are provided for releasably preventing movement of the second end of the first strut away from the first end of the second strut beyond a second expanded distance. The releasable means is releasable to permit movement of the second end of the first strut away from the first end of the second strut beyond the second expanded distance. First means are provided for locking the first end of the first strut in a spaced relationship with the first end of the second strut. Second means are provided for locking the second end of the first strut in a spaced relationship with the second end of the second strut.

In accordance with a further aspect of the present invention, an expandable and collapsible structural module is provided. The module includes four interconnected strut pairs, each strut pair including a first strut, the first strut having a first and a second end, and a second strut, the second strut having a first and a second end. The first end of the first strut of each strut pair is pivotably attached at an outer corner of the module to a second end of a second strut of a preceding strut pair. The first end of the second strut of each strut pair is pivotably attached at an inner corner of the module to a second end of a first strut of a preceding strut pair. The strut pairs are interconnected such that first and second struts of each one of the strut pairs overlie each other in a plane defined by each strut pair. First means are provided for preventing movement of the first ends of the first struts away from the second ends of the second struts beyond a first expanded distance. Releasable means are provided for releasably preventing movement of the second ends of the first struts of a first two non-adjacent ones of the strut pairs away from the first ends of the second struts of the first two non-adjacent ones of the strut pairs beyond a second expanded distance. The releasable means is releasable to permit movement of the second ends of the first struts of the first two non-adjacent ones of the strut pairs away from the first ends of the second struts of the first two non-adjacent ones of the strut pairs beyond the second expanded distance. Second means is provided for preventing movement of the second ends of the first struts of a second two non-adjacent ones of the strut pairs away from the first ends of the second struts of the second two non-adjacent ones of the strut pairs beyond a third expanded distance. Means is provided for locking the outer corners in a spaced relationship with corresponding ones of the inner corners.

In accordance with yet another aspect of the present invention, an expandable and collapsible shelter is provided and includes a series of interconnected, expandable and collapsible structural modules.

BRIEF DESCRIPTION OF THE DRAWINGS

The features and advantages of the present invention are further understood by reading the following detailed description in conjunction with the drawings in which like numerals indicate similar elements and in which:

FIGS. 1A–1D are schematic perspective views of shelters according to embodiments of the present invention;

FIG. 2A is a schematic perspective view of the shelter of FIG. 1C in a completely folded condition;

FIG. 2B is a schematic perspective view of a framework for the shelter of FIG. 1C in a fully erected condition;

FIG. 2C is a schematic perspective view of the erected framework of FIG. 2B attached to an inner cover;

FIG. 8A is a side view of a hub assembly according to an embodiment of the present invention;

FIG. 8B is a side, partially cross-sectional view of the hub assembly of FIG. 8A, taken at the section 8B—8B of the top view of the hub assembly shown in FIG. 8E;

FIG. 8C is a side view of a blade housing for use with the hub assembly of FIG. 8A;

FIG. 8D is a side view of portions of a spring biased blade assembly for use with the hub assembly of FIG. 8A;

FIG. 8E is a top view of the hub assembly of FIG. 8A;

FIG. 8H is a partially cross-sectional top view of a jacket assembly, strut blade, and strut attachable to the hub assembly of FIG. 8A;

FIG. 8I is an exploded, perspective view of the jacket assembly, strut blade, and strut shown in FIG. 8H;

FIGS. 10A–10F are schematic views of stages in the erection of a shelter according to an embodiment of the present invention.

DETAILED DESCRIPTION

Figure 3:
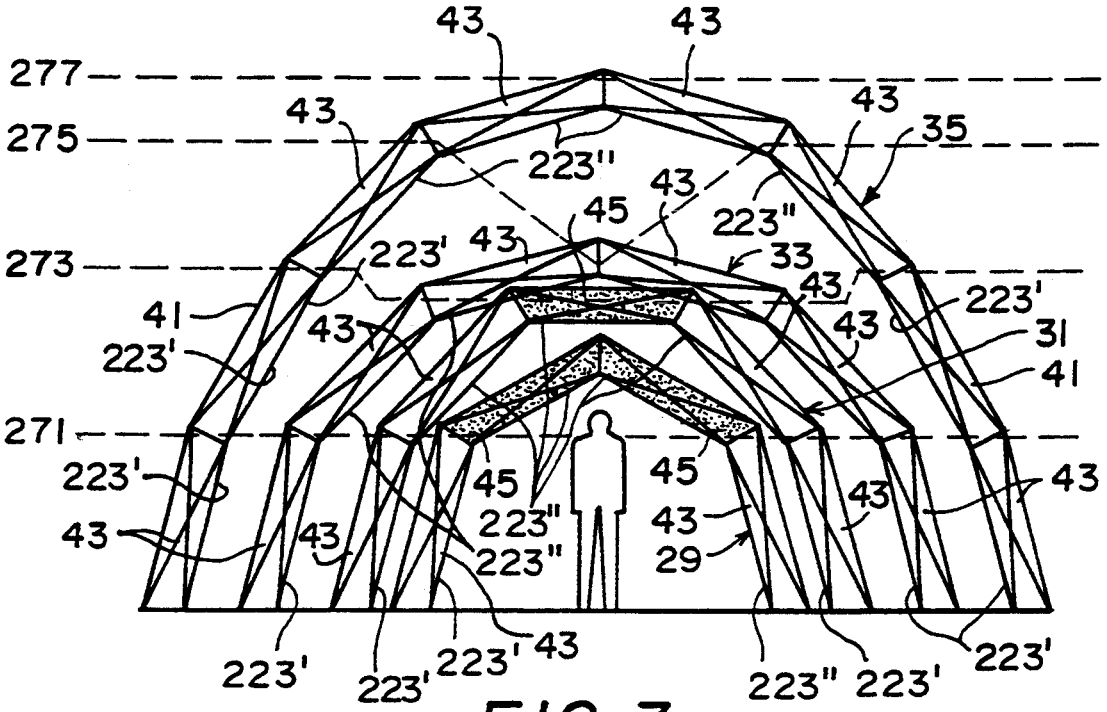
FIG. 3 is a schematic front view of the frameworks of the shelters of FIGS. 1A–1D nested relative to one another.

Expandable and collapsible modular shelters 21, 23, 25, and 27 according to embodiments of the present invention are seen in FIGS. 1A–1D, respectively. Using the shelter 25 of FIG. 1C as an example, certain individual features common to all of the shelters are shown in FIGS. 2A–2C. Each shelter 21, 23, 25, and 27 includes an expandable and collapsible framework, 29, 31, 33, and 35, respectively. The frameworks 29, 31, 33, and 35 of the shelters 21, 23, 25, and 27 are shown nested inside of one another for purposes of comparison in FIG. 3. The framework 33 of the shelter 25 of FIG. 1C is seen in FIG. 2A in its folded state and in FIG. 2B in its expanded state. An inner cover 37 is attached inside the framework 33, as seen in FIG. 2C, and an outer cover 39 is attached outside the framework, as seen in FIG. 1C. Inner and outer covers corresponding to the shapes of the frameworks 29, 31, and 35 are provided for the shelters 21, 23, and 27, respectively. The inner and outer covers form a thermal barrier and are preferably made of a flexible, waterproof, fire-resistant, and ultraviolet resistant material.

Figure 4A:
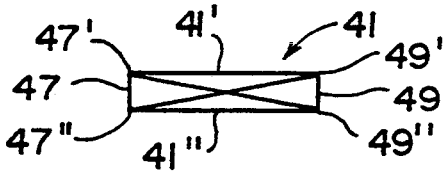
FIGS. 4A–4C are schematic front views of different types of structural modules according to embodiments of the present invention.
Figure 4B:
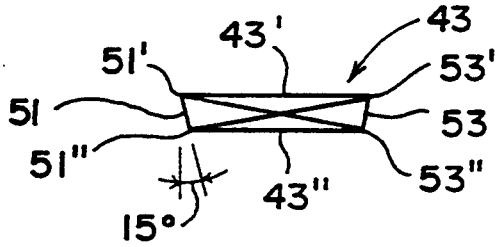
Figure 4C:
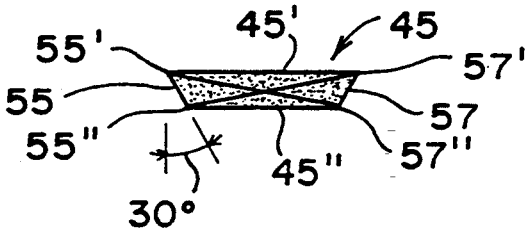

The frameworks 21, 23, 25, and 27 are each formed of combinations of one or more of at least three types of structural modules, namely, a 0° module 41, a 30° module 43, and a 60° module 45, seen individually in FIGS. 4A, 4B, and 4C, respectively. The 0° module 41, the 30° module 43, and the 60° module 45 are so named because of the angles formed by horizontal sides of the modules, i.e., those sides of the module intended to be substantially parallel with the ground. The 0° module 41 has an exterior side 41' and an interior side 41'' that are substantially the same length between the horizontal sides 47, 49 such that a 0° angle between the exterior corners 47', 49' and adjacent ones of the interior corners 47'', 49'' of the horizontal sides is formed.

The 30° module 43 includes an exterior side 43' that is longer than an interior side 43'' between the horizontal sides 51, 53 such that a 15° angle between the exterior corners 51', 53' and adjacent ones of the interior corners 51'', 53'' of the horizontal sides is formed, thereby totalling a 30° angle. The 60° module 45 includes an exterior side 45' that is longer than an interior side 45'' between the horizontal sides 55, 57 such that a 30° angle between the exterior corners 55', 57' and adjacent ones of the interior corners 55'', 57'' of the horizontal sides is formed, thereby totalling a 60° angle. The vertical sides of the modules 41, 43, and 45 are preferably 0°, i.e., the exterior and interior sides of the modules are substantially the same length between the vertical sides such that a 0° angle is formed between exterior corners and adjacent ones of the interior corners.

As can be seen in FIG. 3, the 0° module 41, the 30° module 43, and the 60° module 45 facilitate the construction of a wide variety of frameworks. It is understood, however, that additional modules having horizontal edges forming angles other than 0°, 30°, and 60° may be provided to form frameworks other than those specifically illustrated. For example, U.S. Pat. No. Re. 33,710, the disclosure of which is hereby incorporated by reference, discloses transitional modules having horizontal sides that total 90° angles. Moreover, if desired, modules having vertical sides that form angles between exterior and interior sides of the module may be provided such as are disclosed in U.S. Pat. No. 5,230,196, which is incorporated by reference.

Figure 7:
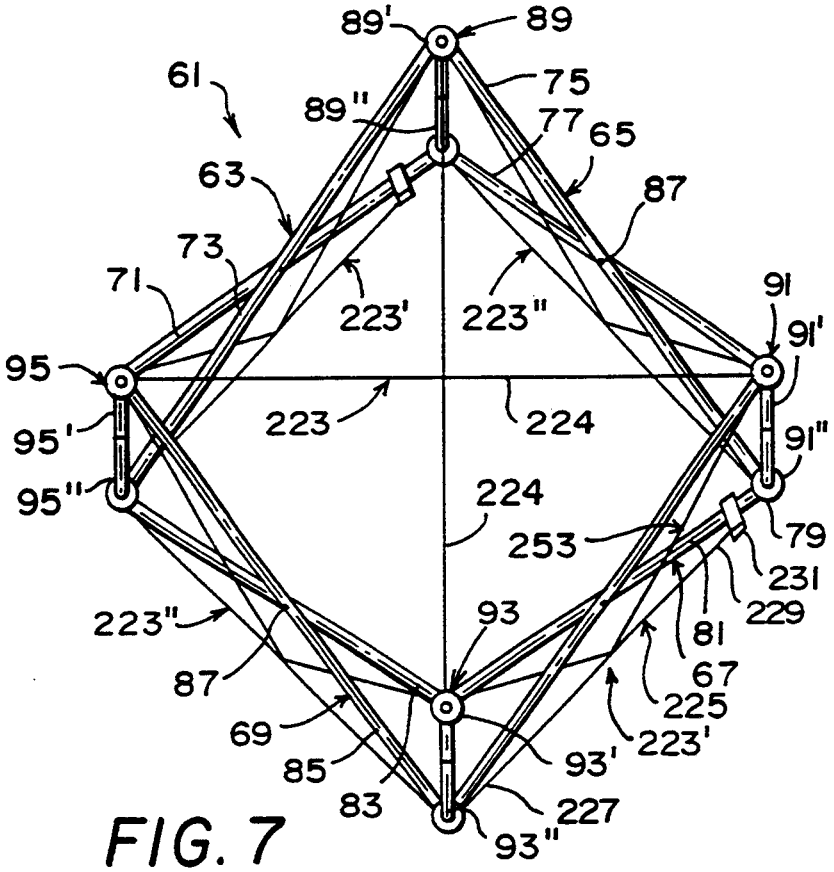
FIG. 7 is a perspective view of a structural module according to an embodiment of the present invention in an expanded condition.

Each module 41, 43, and 45 preferably includes substantially the same features. A generic module 61 is shown in a collapsed or folded condition in FIG. 5; in its movement between an intermediate, partially collapsed condition, and a fully expanded condition in FIG. 6 (attached to another module 21'); and in a fully expanded condition in FIG. 7. It is seen from the comparison of FIGS. 6 and 7 that the modules 61 shown in those drawings are somewhat different. Specifically, the module shown in FIG. 6 is a 30° module and the module shown in FIG.7 is a 0° module. It is understood, however, that the description of the generic module 61 is generally applicable to each of the preferred types of modules 41, 43, and 45, except where otherwise noted. The differences between the types of modules 41, 43, and 45 are discussed above, and are further discussed below.

With reference to FIG. 7, it is seen that the module 61 includes four interconnected "scissors" or pairs 63, 65, 67, and 69 of struts. The strut pair 63 includes struts 71 and 73; the strut pair 65 includes struts 75 and 77; the strut pair 67 includes struts 79 and 81; and the strut pair 69 includes struts 83 and 85. Struts 75 and 77 and struts 83 and 85 of the strut pairs 65 and 69, respectively, are preferably pivotably pinned to one another by means 87 such as pins or rivets.

The strut pairs 65 and 69 define horizontal sides of the module 61. For the preferred 0° modules 41, 30° modules 43, and 60° modules 45 the pivotable pinning means 87 is located at the center of the struts of the strut pairs 65 and 69. As discussed below, when the module is fully erected, the points at which the struts of the strut pairs 63 and 65 overlie or intersect with one another in a 0° module 41, a 30° module 43, and a 60° module 45 are easily calculated.

The module 61 further includes four hub assemblies 89, 91, 93, and 95 each pivotably attached or connected to two adjacent pairs of the strut pairs 63, 65, 67, and 69. The hub assemblies 89, 91, 93, and 95 each include an outer hub assembly 89', 91', 93', and 95' that mates with an inner hub assembly 89", 91", 93", and 95". The struts 73 and 75 are pivotably attached or connected, at substantially right angles to one another, to the outer hub assembly 89', and the struts 71 and 77 are pivotably attached, at substantially right angles to one another, to the inner hub assembly 89". In like fashion, the struts 77 and 79 are pivotably attached to the outer hub assembly 91', and the struts 75 and 81 are pivotably attached to the inner hub assembly 91". The struts 81 and 83 are pivotably attached to the outer hub assembly 93', and the struts 79 and 85 are pivotably attached to the inner hub assembly 93". The struts 85 and 71 are pivotably attached to the outer hub assembly 95', and the struts 83 and 73 are pivotably attached to the inner hub assembly 95".

The circumscribing struts of the strut pairs 63, 65, 67, and 69 are preferably woven in a particular pattern to distribute bending actions on the struts evenly while assuring that the inner and outer hub assemblies are in spaced registry with each other when the framework is expanded. As seen with reference to FIG. 7, the weaving pattern results in the successive struts 73, 75, 81, and 83 being disposed, at the point of intersection (i.e., where those struts overlie one another) with the corresponding successive struts 71, 77, 79, and 85, respectively, on the interior of the module 61.

The hub assemblies 89, 91, 93, and 95 are preferably all substantially identical, such that discussion of one of the hub assemblies applies to all of the hub assemblies, except as otherwise indicated. The features of a hub assembly according to a preferred embodiment of the invention are shown with reference to FIGS. 8A–8G, using the hub assembly 89 for purposes of discussion.

As seen in FIGS. 8A and 8B, the outer and inner hub assemblies 89' and 89" include hubs 97 and 99, respectively, secured at a distance from one another at outer ends of outer and inner portions 101 and 103, respectively. The outer and inner portions 101 and 103 form parts of a compression lock assembly 105 that locks the outer and inner hub assemblies 89' and 89" together when the module 61 is unfolded and the outer and inner hub assemblies are compressed together. The outer and inner portions 101 and 103 are preferably hollow tubular members and are locked together by a spring biased blade assembly 107 of the compression lock assembly 105.

The blade assembly includes a blade holder 109, seen in FIG. 8C, and a pair of blades 111 and 113, seen in FIG. 8D, pivotably mounted at first ends 115 and 117 thereof, respectively, by a collar and/or pivot pin 119, in a cavity 121 (shown in FIG. 8C without the blades) formed in the blade holder. One or more torsion springs 123 are disposed around the pivot pin 119 to urge second ends 125 and 127 of the blades 111 and 113, respectively, in opposite directions radially out of the cavity 121 of the blade holder 109. The blades 111 and 113 are preferably provided with bores or other means, such as protruding portions 111' and 113', for holding ends of the torsion spring 123. Ends of the torsion spring 123 press against, for example, the protruding portions 111' and 113' to urge the blades 111 and 113 radially out of the cavity 121. Button portions 129 and 131 are disposed at, and preferably formed on, the second ends 125 and 127 of the blades 111 and 113, respectively.

As seen in FIGS. 8A and 8B, the blade assembly 107 is secured in an inner end of one of the outer and inner portions 101 and 103 such that the second ends 125 and 127 of the blades 111 and 113 extend a small distance outside of the outer or inner portion. The blade assembly 107 is preferably secured in the outer or inner portion 101 or 103 by the pivot pin 119 which, if desired, passes through a collar on which the blades 111 and 113 are pivotably mounted. The blade assembly 107 may, however, be secured in the outer or inner portion 101 or 103 by any other appropriate means, such as by a separate pin or rivet, by a threaded connection, or by a compression fit.

In the hub assembly 89 shown in FIGS. 8A and 8B, the blade assembly 107 is shown secured inside the outer portion 101. The inner portion 103 receives a male leading end 133 of the blade holder, along with the button portions 129 and 131 and the second ends 125 and 127 of the blades. The button portions 129 and 131 are preferably formed with chamfered ends 135 and 137 such that, as the second ends 125 and 127 of the blades, which are normally biased radially outwardly by the torsion spring 123, are inserted into the inner portion 103, the second ends of the blades are retracted into the cavity 121 of the blade holder 109.

The wall 139 of the inner portion 103 is formed with a pair of opposed apertures 141 and 143. When the leading end 133 of the blade holder 109 is inserted to a sufficient depth in the inner portion 103, the button portions 129 and 131 are urged radially outwardly by the torsion spring 123 into the apertures 141 and 143, respectively, to lock the outer portion 101 to the inner portion. When it is desired to separate the outer portion 101 from the inner portion 103, the button potions 129 and 131 are preferably manually compressed into the apertures 141 and 143 and the outer portion and the inner portion are drawn axially apart from one another.

The button portions 129 and 131 on the blades 111 and 113 preferably extend out of the outer portion 101 and into the inner portion 103 a sufficient distance to minimize risk of failure of the portion of the wall 139 of the inner portion between the apertures 141 and 143 and the end of the inner portion when the locked inner and outer portions are placed in tension. Further, the male leading end 133 of the blade holder 109 preferably extends into the inner portion 103 a sufficient distance to maximize the ability of the locked inner and outer portions to absorb bending forces. Compression lock assemblies according to the present invention have been observed to withstand tension forces of up to 600 pounds. The compression lock assembly 105 facilitates the formation of larger shelters than was previously practical, in that modules formed with hubs including such compression lock assemblies have sufficient strength to withstand large loads due to forces such as wind, snow, etc.

Figure 8F:
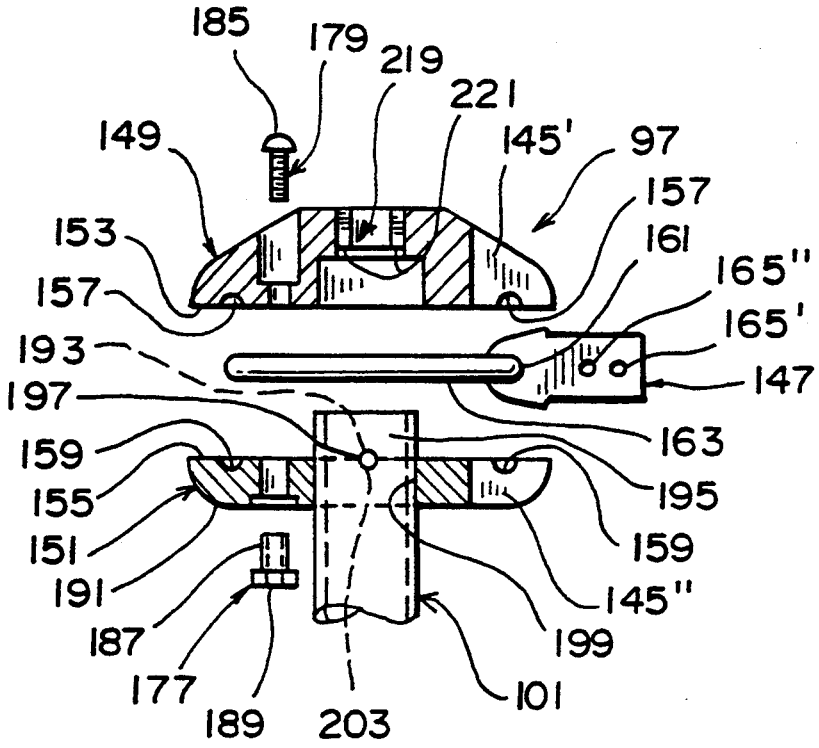
FIG. 8F is an exploded view of a portion of the hub assembly of FIG. 8A.
Figure 8G:
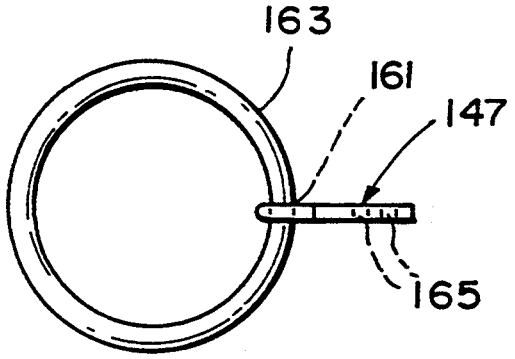
FIG. 8G is a top view of a ring and strut blade for use with the hub assembly of FIG. 8A.

As seen in FIGS. 8A and 8B, the hubs 97 and 99 of the hub assembly 89 are preferably substantially identical to one another, except as otherwise indicated. Hubs adaptable for use in connection with the present invention are disclosed in U.S. Pat. No. 4,280,521, the disclosure of which is hereby incorporated by reference. Other hubs adaptable for use in connection with the present invention are disclosed in U.S. Pat. No. 4,838,003, which is also hereby incorporated by reference. As seen in FIG. 8E, referring to the hub 97 for purposes of discussion, the hubs preferably include one or more radial slots 145, preferably eight slots, for pivotably mounting strut blades 147. The strut blades 147 are seen in FIGS. 8B, 8F, and 8G.

As seen in FIGS. 8B and 8F, the hub 97 preferably includes a top half 149 and a bottom half 151, having mating faces 153 and 155, respectively. The mating faces 153 and 155 are each formed with mating, ring-shaped, half-circular grooves 157 and 159, respectively, seen as dashed lines in FIG. 8E. The top half 149 and the bottom half 151 are each formed with portions 145' and 145", respectively, of the slots 145 so that, when the top half and the bottom half are attached to one another, the slots in the hub 97 are formed. Bores 161 are formed in the strut blades 147 for receiving a ring 163, as seen in FIGS. 8B, 8F, and 8G. One or more strut blades 147 are provided on each ring 163. The ring 163 is clamped between the mating faces 153 and 155 in the grooves 157 and 159 with the strut blades 147 received in desired ones of the slots 145. The strut blades 147 pivot in the slots 145 relative to the hub 97 on the ring 163.

The strut blades 147 are preferably flat members, formed from a strong material such as sheet metal. An exterior bore 165' and an interior bore 165" are formed in the strut blades 147 for mounting the struts. The struts that are mounted on the strut blades 147 are preferably cylindrical tubular members, with cylindrical interior openings. A jacket assembly 166, seen in FIGS. 8H and 8I, is preferably provided for mounting the struts on the strut blades 147 and minimizing play between the struts and the strut blades. The mounting of the strut 79 on a strut blade 147 is shown by way of illustration in FIGS. 8H and 8I.

Each jacket assembly 166 preferably includes a male end 167 receivable in the interior opening of a strut, the male end extending from a ranged end 168 that is not able to enter the cylindrical opening of the strut. Each jacket assembly 166 preferably includes a pair of identical jacket halves 169, 169 that are placed on opposite flat sides 147A, 147B of a strut blade 147. Each jacket half 169 is further formed with one bore 170 that aligns with the exterior bore 165' of a strut blade 147 and one bore 171 that preferably extends from an inner face 172 of the jacket half 169 to a predetermined depth and that aligns with the interior bore 165" in the strut blade. A pin or rivet 173 is provided and fits in the bores 171 in each of the jacket halves 169, 169 and through the interior bore 165" in the strut blade 147 to orient the jacket halves relative to the strut blade.

The struts are formed with bores 174 that align with the exterior bore 165' of the strut blades and the bores 170 of the jacket halves 169, 169. A strut, a jacket, and a strut blade are fixed together by means 175 such as rivets, bolts, pins, etc. A plastic sleeve 176 (not seen in FIG. 8I) having bores that align with the bores 170 of the jacket halves 169, 169, the exterior bore 165' of the strut blade 147, and the bores 174 of the struts is preferably inserted in the strut before the male end 167 of the jacket assembly 166 and has an interior diameter substantially equal to the exterior diameter of the jacket assembly to provide a tight fit. The jacket halves 169, 169 may be formed from any suitable material, such as a rubber or plastic material, or a metallic material. As disclosed in U.S. Pat. No. 4,280,521, the jacket halves 169, 169 may also be formed of a deformable material such that the struts may be attached to the strut blades 147 by being crimped so that the jacket material compresses around the strut blades to secure the struts to the strut blades.

The top half 149 and the bottom half 151 of the hub 97 are preferably fastened to one another by nuts 177 and bolts 179, seen in FIGS. 8B, 8E, and 8F, received in openings 181 and 183, respectively, formed in the bottom half and the top half, respectively, of the hub. Four sets of nuts 177 and bolts 179 preferably fasten the top half 149 and the bottom half 151 together. As seen in FIGS. 8B and 8F, the opening 183 for receiving the bolts 179 is preferably countersunk for providing a bearing surface for the bolt head 185. The bolt head 185 is preferably a machine screw-type head such as screw-type head or a socket-type head capable of being driven by a screw driver or an Allen wrench so that the bolt head is able to be turned when it is sunk into the opening 183. The nuts 177 preferably include an internally threaded shank portion 187 for receiving the threaded portions of the bolts 179 and a headed portion 189 disposed at the end of the shank portion for bearing against an outside surface 191 of the bottom half 151. The headed portion 189 is preferably hexagonal or any other suitable shape for being held by a conventional wrench.

The hub 97 is secured to the outer portion 101 of the compression lock assembly 105 when the top half 149 and the bottom half 151 of the hub are fastened together by the nuts 177 and bolts 179. As seen in FIG. 8F, a bore 193 is formed through the outer portion 101 near an outer end 195 of the outer portion and a pin 197 is fitted in the bore. The bottom half 151 and a portion of the top half 149 are formed with substantially central, axial openings 199 and 201, respectively, for receiving the outer end 195 of the outer portion 101. At least one of the mating faces 153 and 155 of the top half 149 and the bottom half 151 of the hub are formed with radial grooves 203 (seen in FIG. 8F for the bottom half only) for receiving the pin 197. When the top half 149 and the bottom half 151 are fastened together by the nuts 177 and bolts 179, the hub 97 is secured in position relative to the outer portion 101 by the pin 197 clamped in the grooves 203 between the mating faces 153 and 155.

The outer hub assembly 89' and the inner hub assembly 89" each preferably further include substantially identical means 205 for holding the outer cover 39 and the inner cover 37, respectively, in position relative to the hub assembly 89. The inner and outer covers 37 and 39 are preferably suitable flexible cover materials, and cover holders 209, seen in FIG. 8B (not showing the inner cover 37), are attached in appropriate locations on the inner and outer covers for fastening the covers to the hub assemblies of the framework of the particular shelter type.

As seen in FIG. 8B, the cover holder 209 (shown by dashed lines attached to the outer cover 39 in a position prior to insertion in the hub 97, and in solid lines inserted in the hub, without the outer cover, which is not shown for clarity of illustration) of the cover holding means 205 includes a male portion 211 extending, at a first end of the male portion, from a flanged portion 213. The flanged portion 213 is preferably secured in position relative to the cover 39 between the cover and a patch 39A having a central opening 39B through which the male portion 211 extends by heat sealing the patch to the cover. The male portion 211 includes a substantially T-shaped, radially flared second end 215, having a pair of opposed grips 217. The male portion 211 is preferably substantially rectangular, and is preferably wider in the direction of the grips 217 than in the direction perpendicular to the grips.

The hub 97 is formed with a keyed axial opening 219 in a portion of the top half 149, aligned with the opening 201 for receiving the outer end 195 of the outer portion 101. The keyed opening 219 is formed to permit the flared second end 215 of the male portion 211 of the cover holder 209 to pass through the keyed opening when the cover holder is oriented in one direction, but not when the cover holder is oriented in any other direction. When the second end 215 of the cover holder 209 is properly oriented and is inserted through the keyed opening 219 and into outer end 195 of the outer portion in the opening 201 of the top half 149, and the cover holder is turned axially, the grips 217 at the second end of the cover holder are covered by ranged portions 221 of the keyed opening that prevent the cover holder from being axially withdrawn from the hub 97. When the cover holder 209 is turned so that the grips 217 are not covered by the ranged portions 221, the cover holder may be axially withdrawn from the hub 97.

Cover holders 209, preferably equal in number to the number of hub assemblies forming the particular shelter type, are secured to the inner and outer covers 37 and 39 for attaching the covers to the hub assemblies. The covers 37 and 39 are preferably sufficiently flexible to permit the cover holders 209 to be properly oriented by hand for insertion into the corresponding keyed openings 219. Preferably, upon release of the cover holders 209, after insertion into the corresponding keyed openings, the normal tension in the covers 37 and 39 causes the covers holders to reorient themselves such that they are not removable from the keyed openings, except on purpose.

Figure 5:
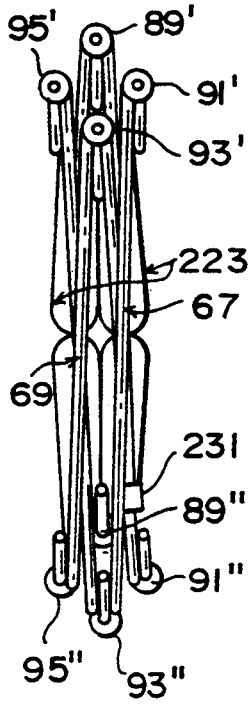
FIG. 5 is a perspective view of a structural module according to an embodiment of the present invention in a folded condition.
Figure 6:
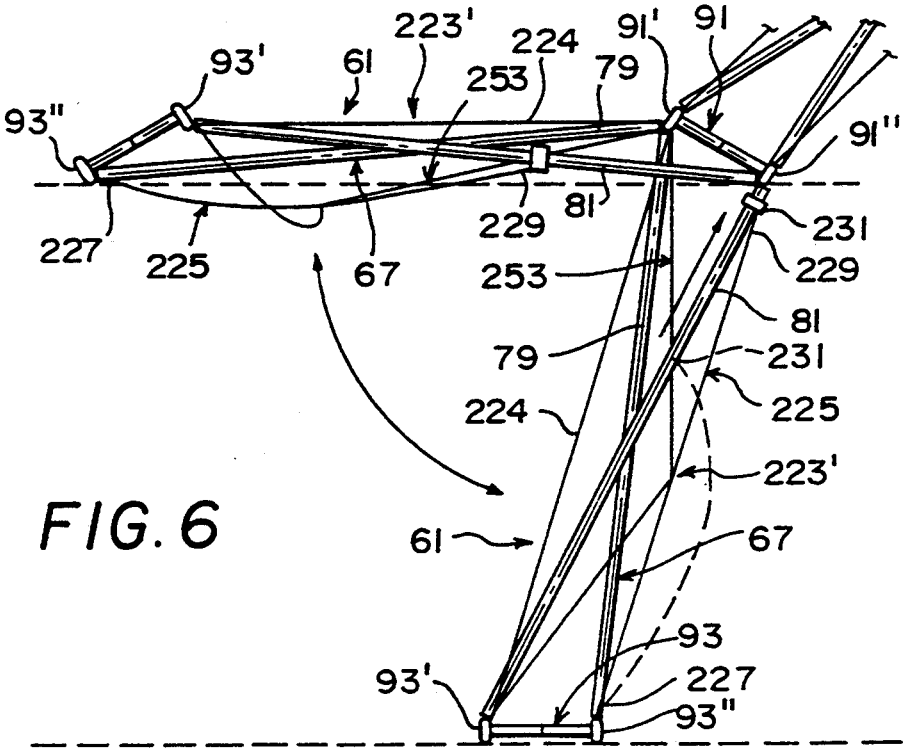
FIG. 6 is a side view of a structural module according to an embodiment of the present invention in a collapsed and in an erected condition.

In the module 61 shown in FIGS. 5–7, and as in U.S. Pat. No. Re. 33,710, the disclosure of which is incorporated by reference, the sum of the distances from an inner hub assembly, e.g., inner hub assembly 89″, along a strut extending therefrom, e.g., strut 77, to the point where the strut 77 crosses the strut 75, e.g., at the pivotable pinning means 87, and back, along the strut 75, to the outer hub assembly 89′, is preferably the same for all struts forming the module at all times. This feature holds true even though, for the different modules, i.e., the 0° module 41, the 30° module 43, and the 60° module 45, the intersection points for at least the vertical sides of those modules, i.e., where the struts of those modules forming the vertical sides of those modules cross, differ.

As noted above, the pivotable pinning means 87 on the strut pairs 65 and 69 is preferably located at substantially the mid-point of the struts 75, 77, 83, and 85. All of the struts 71, 73, 75, 77, 79, 81, 83, and 85 are preferably the same length. When the module 61 is in a fully erected condition, in a 0° module, the struts 71 and 73 of the strut pair 63 and the struts 79 and 81 of the strut pair 67 intersect at substantially the mid-points of those struts. In erected 30° 43 modules and in 60° modules 45, however, the struts of the strut pairs 63 and 67 intersect at a distance from the outer hub assemblies 89′, 91′, 93′, and 95′ that may be determined according to the following relationship:

$$L_1 = \tfrac{1}{2} \times L(\sin[\cos^{-1}(C\cos\Theta_1)/L] + C\sin\Theta_1))/\cos(90° - \cos^{-1}[(C\cos\Theta_1)/L])$$

where $L_1$ = distance from the outer hub assembly to the point of intersection;

L = length of strut;

C = length of hub assembly; and $\Theta_1$ = angle at horizontal sides of module (i.e., 15° for 30° module; 30° for 60° module).

Tension lock means 223 is provided to prevent movement of the ends of the struts of the strut pairs 63, 65, 67, and 69 relative to one another beyond predetermined maximum expanded distances when the module 61 is unfolded. Means including the hub assemblies 89, 91, 93, and 95 and, if provided, the pivotable pinning means 87 on the strut pairs 65 and 69, limit the ends of the struts of the strut pairs 63, 65, 67, and 69 to movement in planes defined by those strut pairs. However, even when the inner and outer hub assemblies of the hub assemblies 89, 91, 93, and 95 are locked together, the ends of the struts of the strut pairs 63, 65, 67, and 69 are able to move in the planes defined by those strut pairs until the tension lock means 223 prevents movement of the ends of the struts. This is seen with reference to FIG. 6, in which it is seen that the module 61 is able to become substantially flat (the "up" position) because the tension lock means is not fully locked. The struts 79 and 81 are able to lie substantially parallel to one another because the inner hub assemblies 91″ and 93″ are not prevented from moving away from one another, except by limits imposed as a result of the length of the struts.

The operation of the tension lock means 223 is described with reference to the preferred embodiment, in which the struts of the strut pairs 65 and 69 are pivotably pinned by the pivotable pinning means 87. To facilitate setting up the shelters from ground level, portions of the tension lock means 223 are preferably so-called "variable" tension lock means 223′, while the remaining portions of the tension lock means are preferably so-called "fixed" tension lock means 223″.

The tension lock means 223 includes a pair of diagonal cables 224, preferably stranded wire cables, one cable extending between the outer hub assemblies 89′ and 93′ and the other cable extending between the outer hub assemblies 91′ and 95′. The diagonal cables 224 are preferably pivotably attached to the outer hub assemblies 89′, 91′, 93′, and 95′ by an eyelet 228 like the one shown in FIG. 8I mounted on the ring 163 and pivotable in a slot 145 formed in an outer hub assembly at a 45° angle to the strut blades pivotably attaching struts to the outer hub assembly. Prior to locking the outer hub assemblies 89′, 91′, 93′, and 95′ to the inner hub assemblies 89″, 91″, 93″, and 95″, respectively, the diagonal cables 224 limit the distance that the outer hub assemblies can move apart from one another. Further, when the outer hub assemblies 89′, 91′, 93′, and 95′ are locked to the inner hub assemblies 89", 91", 93", and 95", respectively, the diagonal cables 224 constrain the outer hub assemblies and thereby limit the ability of the hub assemblies 89, 91, 93, and 95 to rotate.

The inner hub assemblies 89", 91", 93", and 95", however, remain substantially unconstrained and, even after the outer hub assemblies 89', 91', 93', and 95' are locked to the inner hub assemblies 89", 91", 93", and 95", respectively, the module 61 is able to form substantially any shape between the flat ("up") and expanded ("down") conditions shown in FIG. 6. To constrain the movement of the inner hub assemblies 89", 91", 93", and 95", the tension lock means 223 preferably further includes scissor cables 225 arranged, in the case of the fixed tension lock means 223", or, in the case of the variable tension lock means 223', adapted to be arranged between adjacent ones of the inner hub assemblies for locking at least the unpinned strut pairs 63 and 67 of the module 61 in the expanded condition. The pinned strut pairs 65 and 69 are preferably also provided with scissor cables 225. As discussed below, the scissor cables 225 on the variable tension lock means 223' are adapted to be disconnected or released, to permit the module 61 to lie flat, and connected, to lock the module in the expanded condition.

The pivotable pinning means 87 limits, to a degree, the distance that the inner hub assembly pairs 89" and 91", and 93" and 95" on the pinned strut pairs 65 and 69, respectively, can move apart from one another, whether the inner hubs are attached to their respective outer hubs or not. The scissor cables 225 on the unpinned strut pairs 63 and 67, however, limit the distance that the inner hub assembly pairs 95" and 89", and 91" and 93" on the unpinned strut pairs 63 and 67 can move apart from one another, whether the inner hubs are attached to their corresponding outer hubs or not. Thus, to illustrate the function of the scissor cables 225, by manipulating the module 61 such that the scissor cables and the diagonal cables 224 are all in tension, the module is adapted to assume and hold its erected shape, even though the inner and outer hub assemblies of the hubs 89, 91, 93, and 95 are not engaged. It is not, however, until engagement of the inner and outer hub assemblies of the hubs 89, 91, 93, and 95 that the module 61 attains sufficient structural integrity for sustained use under adverse conditions.

The scissor cable 225 for locking the unpinned strut pair 67 is described with reference to FIGS. 6 and 7. The scissor cable 225 is preferably fixed at a first end 227 to one of the inner hub assembly 93" or to a point near the end of the strut 79 attached to the inner hub assembly. The first end 227 of the scissor cable 225 is preferably secured to the end of the strut 79 by an eyelet 228, seen in FIG. 8I, that is fixed to the strut 79 by the fixing means 175 or any other suitable means and that is secured to the first end of the scissor cable by a crimp. For the fixed tension lock means 223", such as is used in the preferred embodiment on all pinned strut pairs and certain unpinned strut pairs in a shelter, as is explained further below, a second end 229 of the scissor cable 225 is secured to the end of the strut 81 by an eyelet (not shown) in the same manner as the first end 227 of the scissor cable.

Figure 9A:
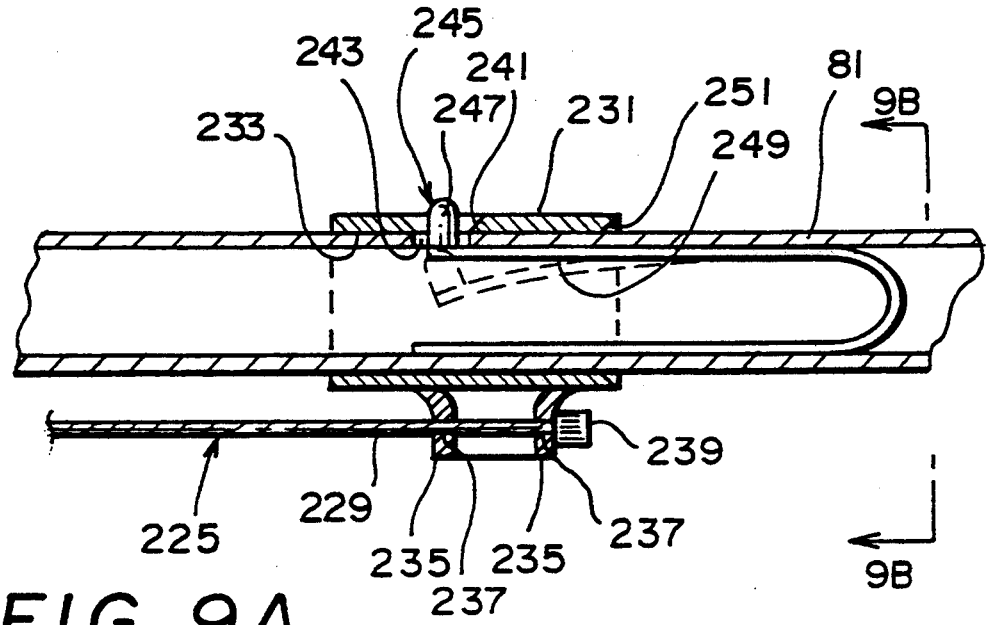
FIG. 9A is cross-sectional side view of a portion of a tension lock means according to an embodiment of the present invention.
Figure 9B:
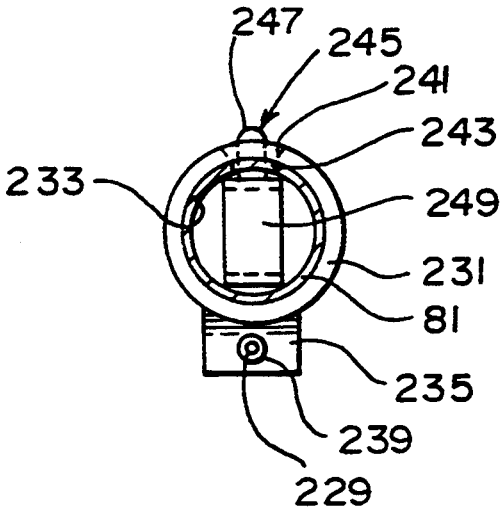
FIG. 9B is a partially cross-sectional view of the tension lock means of FIG. 9A taken at section 9B—9B.

For the variable tension lock means 223', the second end 229 of the scissor cable 225 is fixed to a collar 231 (not shown in FIG. 7) having an axial opening 233 such that the collar, seen in FIGS. 9A–9B, is slidable along the length of the strut 81, as seen in FIG. 6. The collar 231 is provided with one or more attached members 235 including bores 237 formed therein for receiving the second end 229 of the scissor cable 225. The second end 229 of the scissor cable 225 is preferably secured to the collar 231 with a well known cable holder 239.

As seen in FIGS. 9A–9B, the collar 231 is formed with a radial aperture 241 for locking the collar in position on the strut 81. The strut 81 is formed with a radial aperture 243 at a predetermined point along the length of the strut, preferably near the end of the strut pivotably attached to the inner hub assembly 91". A retractable button assembly 245 is provided that urges a button 247 radially out of the aperture 243 in the strut 81. The retractable button assembly 245 preferably includes a spring such as a plate spring 249 that is disposed inside of the strut 81. The button 247 is preferably formed on or fastened to an end of the plate spring 249.

The collar 231 is preferably provided with an internally chamfered leading end 251 for causing the button 247 to automatically radially retract into the aperture 243 in the strut 81 as the collar is slid up the strut. When the aperture 241 in the collar 231 is aligned with the aperture 243 and the button 247, the plate spring 249 urges the button radially outwardly through the aperture 241 to lock the collar in position relative to the strut. A preferred collar 231 is formed from a "T" pipe or conduit fitting, preferably plastic, wherein the aperture 241 may comprise the opening in the central part of the "T" (or another opening formed opposite the opening in the central part of the "T") and the bores 237 are formed in the walls of the central part of the "T".

The length of the scissor cable 225 is preferably selected such that, when the collar 231 is locked in position relative to the strut 81, the scissor cable is in tension and draws the ends of the struts 79 and 81 attached to the inner hub assemblies 93" and 91", respectively, toward one another, so that the module 61 is raised from a flattened condition. Thus, when the collars 231 attached to the scissor cables 225 around the module 61 lock the scissor cables in tension, the ability of the inner hub assemblies 89", 91", 93", and 95" to rotate is constrained. If the length of the scissor cables 225 is assumed to be equal to the center-to-center distance between adjacent inner hub assemblies then, for the particular modules 41, 43, and 45, the length of the scissor cable is determined according to the relationship:

$$L_s = L\sin[\cos^{-1}(C\cos\Theta_1)/L] - C\sin\Theta_1$$

where:

$L_S$=length of scissor cable.

Similarly, if the lengths of the diagonal cables 224 are assumed to be equal to the center-to-center distance between the non-adjacent outer hub assemblies, and all of the struts are the same length, then the length of a diagonal cable is determined according to the relationship:

$$L_d = \sqrt{2(L\sin[\cos^{-1}(C\cos\Theta_1)/L] + C\sin\Theta_1)^2}$$

where:

$L_D$=length of diagonal cable. As noted above, all of the struts making up the modules 41, 43, and 45 are preferably the same length. The length of the diagonal cables 224 and the scissor cables 225, however, differs between the different modules 41, 43, and 45. For example, the length of the diagonal cables 224 is greatest for the 60° module and smallest for the 0° module, and the length of the scissor cables 225 on the unpinned strut pairs is smallest for the 60° module and is greatest for the 0° module. Thus, when the scissor cables 225 and the diagonal cables 224 of a module 61 are in their fully expanded conditions, an angle between the plane defined by the hub assemblies 89 and 91 (or the strut pair 65) and the hub assemblies 93 and 95 (or the strut pair 69) depends on the lengths of the scissor cables arranged between the ends of struts forming the strut pairs 63 and 67 and the diagonal cables arranged between the outer hub assemblies 89 and 93 and 91 and 95.

When the module 61 is folded, the scissor cables 225 are preferably retained in an organized, looped configuration, as seen in FIG. 5, by cable keepers 253 corresponding to each scissor cable. The cable keepers 253 are preferably in the form of a cable secured at its ends to adjacent ones of the outer hub assemblies 89', 91', 93', and 95', respectively, or near the ends of the struts attached to those outer hub assemblies. The cable keepers 253 are preferably wrapped around the corresponding scissor cables and, when the scissor cable 225 is placed in tension to urge the ends of the struts 79 and 81 attached to the inner hub assemblies 93" and 91", respectively, toward one another, the mid-points of the cable keepers contact the scissor cables at substantially the mid-point of the scissor cables. Other cable keepers suitable for use in connection with the scissor cables 225 are disclosed, for example, in U.S. Pat. No. 5,230,196, which is hereby incorporated by reference. The tension lock means 223 provides flexibility to the frameworks of the shelters, and facilitates allowing the shelters to yield, without failing, under adverse conditions such as high winds, while providing structural strength with light-weight elements.

Although the tension lock means 223 has been described in accordance with the embodiment shown in FIGS. 6–7, it is understood that variations on the tension lock means may be provided. For example, instead of providing the diagonal cable 224 between non-adjacent outer hub assemblies, cables serving the same purposes, such as limiting the range of movement of the outer hub assemblies and opposing forces resulting from the scissor cables, may be provided between adjacent ones of the outer hub assemblies across at least the unpinned strut pairs 63 and 67. If desired, such cables may be releasably arranged between adjacent ones of the outer hub assemblies with a collar device similar to that used with the cable 225. The diagonal cables 224 may also be provided with means (not shown) such as hooks for releasably attaching the diagonal cables from between non-adjacent outer hub assemblies to permit substantially unconstrained movement of the outer hub assemblies in a manner similar to the manner in which the scissor cable 225 of the variable tension lock means 223' is releasable to permit substantially unconstrained movement of inner hub assemblies.

The scissor cables 225 on the strut pairs 65 and 69 that are pinned to one another may be eliminated. Further, if scissor cables 225 are provided on the pinned strut pairs 65 and 69, the pivotable pinning means 87 may be eliminated. Scissor cables 225 provided on the strut pairs 65 and 69 are not ordinarily attached to the struts with a sliding or releasable collar arrangement, as on the scissor cables on the strut pairs 63 and 67, because, in the preferred embodiment, it is not useful for those pinned strut pairs to attain a flattened condition. Scissor cables 225 provided on the pinned strut pairs 65 and 69 are preferably attached to the inner hubs 89", 91", 93", and 95" with eyelets 228, such as are preferably used at the end 227 of the scissor cable 225 extending between the inner hubs 91" and 93" of the unpinned strut pair 67, discussed above, or are attached by other suitable means to the inner hubs. While, as noted above, it is not necessary to provide scissor cables on pinned strut pairs or pivotable pinning means on strut pairs provided with scissor cables, it is preferred to provide both pivotable pinning means and scissor cables for optimal structural integrity of the module.

It is also possible to essentially reverse the location of the scissor and diagonal cables, such that the scissor cables are provided between adjacent outer hub assemblies and the diagonal cables are provided between non-adjacent inner hub assemblies. This embodiment is, however, less preferred because, when putting up a shelter formed from such modules, it is somewhat less convenient to gain access to an outer portion of the modules to lock the scissor cables in position.

Preferably, the diagonal cables 224 and the scissor cables 225 are formed of stranded metal wire cables. Alternatively, however, rigid or substantially rigid members may be used in place of the diagonal cables and the scissor cables. For example, the diagonal and/or scissor cables may be replaced with rods that are adapted to be attached and detached from one or more of the inner or outer hub assemblies in order to set up and fold up, respectively, the module. If desired, such rods may be hinged in their centers and/or at their connections to the hub assemblies to avoid the need for attaching and detaching the rods during setting up and taking down of the shelters.

Shelters according to the present invention are erected as shown in FIGS. 10A–10F, which illustrate the erection of the shelter 25 shown in FIGS. 1C, 2A–2C, and 3. For purposes of clarity, the framework 33 of the shelter 25 is shown in FIGS. 10A–10F without the inner and outer covers 37 and 39. Ordinarily, the outer cover 39 is attached to the framework 33 prior to erection of the shelter, such as by attachment at a manufacturing site, and the inner cover 37 is attached at the point of use.

While the inner cover 37 may be attached to the framework 33 prior to erection of the shelter 25, leaving the inner cover off until the framework is erected facilitates access to the hub assemblies 89, 91, 93, and 95 for locking the compression lock assemblies 105 and facilitates access to the tension lock means 223. Moreover, leaving the inner cover 37 off until after the framework 33 is erected facilitates installing any electrical wiring, insulation, ventilation, or other equipment between the inner and outer covers of the shelter. Further, since the outer cover 39 is preferably already on the framework 33, once the framework is erected, workers or others have shelter while the inner cover 37 is attached.

While the shelters 21, 23, 25, and 27 may be put up, without tools, by a single person at ground level, preferably, two or more persons are available to put up the shelters. FIG. 10A shows the folded shelter 25. The folded shelter 25 includes a number (preferably 24) of interconnected 30° modules 43 which, in a folded condition, appear similar to the folded module 61 seen in FIG. 5. Adjacent ones of the modules 43 are connected to one another by shared hub assemblies 269. Each hub assembly 269 thus forms a part of one or more modules 43.

FIG. 10B shows that the framework 33 is easily unfolded in substantially accordion-like fashion. The unfolded framework 33 is shown in FIG. 10C. The outer and inner hub assemblies 269' and 269" are not yet locked together by forcing together the inner and outer portions of the compression lock assemblies (not shown) of the hub assemblies 269. However, upon unfolding the framework 33 and placing the diagonal cables 224 and the scissor cables 225 of the fixed tension lock means 223" in tension, the framework is caused to assume a partially erected condition. Because the scissor cables 225 of the variable tension lock means 223' on certain of the modules making up the framework 33 are not yet arranged between their corresponding inner hub assemblies, however, only an upper portion of the framework attains the partially erected condition, and the modules including variable tension lock means are adapted to lie substantially flat. As seen in FIG. 10D, the workers at ground level are easily able to reach the hub assemblies 269D and 269C to engage the inner and outer hub assemblies 269D", 269D' and 269C", 269C'.

Figure 10E:
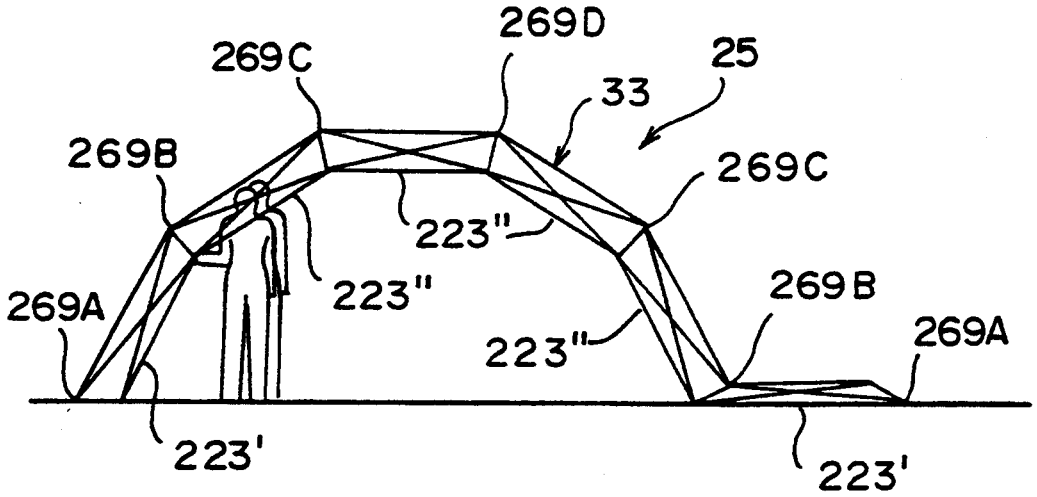
Figure 10F:
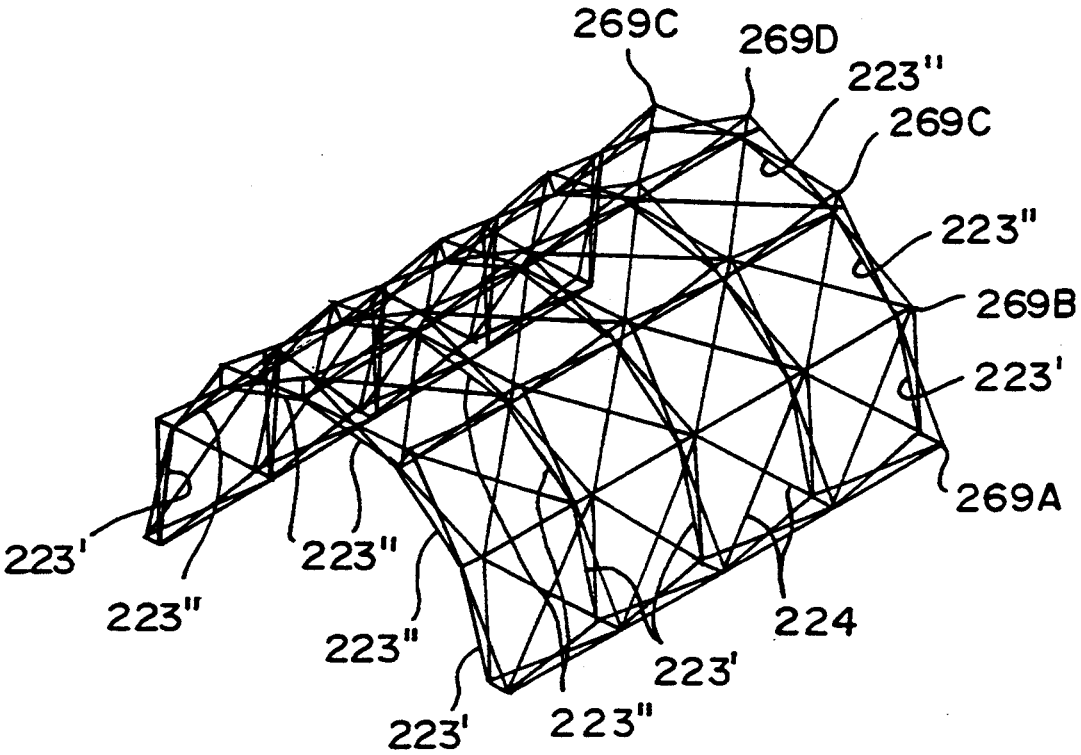

As seen in FIG. 10E, upon arranging the scissor cables 225 of the variable tension lock means 223' between the inner hub assemblies of the hub assemblies 269A and 269B, the framework 33 assumes a more substantially erected condition. Workers at ground level are, however, still easily able to reach the inner and outer hub assemblies of the hub assemblies 269A and 269B for the purpose of engaging the inner and outer hub assemblies. It will be appreciated that, without the variable tension lock means 223', upon unfolding a framework provided only with fixed tension lock means, it would be difficult to engage the inner and outer hub assemblies of the hub assemblies 269C and 269D as, at least in certain shelter types according to the present invention, these hub assemblies would be at great heights. Upon arranging the scissor cables 225 of the variable tension lock means 223' between the inner hub assemblies of the hub assemblies 269A and 269B on both sides of the framework 33 and upon engaging the inner and outer hub assemblies of all of the hub assemblies of the framework, the framework attains the set up condition shown in FIG. 10F.

According to the preferred embodiment, struts forming the modules are approximately 5 feet in length. With reference to the embodiments illustrated in FIG. 3, the interior height of the shelter 21 is approximately seven feet, the interior height of the shelter 23 is approximately eight feet, the interior height of the shelter 25 is approximately nine feet, and the interior height of the shelter 27 is approximately thirteen and one half feet. To facilitate setting up of the shelters 21, 23, 25, and 27 by workers at ground level, each shelter is provided with a sufficient number of variable tension lock means 223' to avoid the necessity of ladders or similar means for most workers (assuming these workers to be of average heights) in setting up the shelters.

As is seen in FIG. 3, all of the frameworks 29, 31, 33, and 35 are comprised of one or more "levels". A first level 271 is at the intersection of the first set of modules from ground level with a second set of modules, a second level 273 is at the intersection of the second set of modules with a third, a third level 275 is at the intersection of the third set of modules with a fourth, a fourth level 277 is at the intersection of the third set of modules with a fifth, and so on, depending upon the size of the particular framework. Thus, the peak of the framework 29 is at a second level, the uppermost module of the framework 31 attaches to lower modules at a second level, the peak of the framework 33 is at the third level 275, and the peak of the framework 35 is at the fourth level 277.

Because, in the preferred embodiment, each of the frameworks 29, 31, 33, and 35 have different interior heights, more variable tension lock means 223' are preferably provided on the tallest ones of the frameworks. For example, the framework 35 is preferably provided with variable tension lock means 223' on the modules extending up to the second level 273. The frameworks 31 and 33 are each preferably provided with variable tension lock means 223' on the modules extending up to the first level. The framework 29 is preferably provided with variable tension lock means 223' on modules extending up to the first level, but preferably only on one side of the framework because the module is sufficiently low such that, even when the remaining modules, all of which are provided with fixed tension lock means 223", are in their expanded conditions, a worker at ground level should be able to conveniently reach all of the hub assemblies on the module. It is, of course, understood that, if desired, all of the tension lock means 223 provided on the modules making up a framework may be variable tension lock means. Further, it is understood that the foregoing arrangements of modules and tension lock means is merely illustrative of several preferred embodiments.

Embodiments of the shelter 21 shown in FIG. 1A provide approximately 100 $ft^2$ of floor space unobstructed by inner poles or outer ropes and only weigh approximately 79 lbs. Embodiments of the shelter 23 shown in FIG. 1B provide approximately 195 $ft^2$ of unobstructed floor space and only weigh approximately 142 lbs. Embodiments of the shelter 25 shown in FIG. 1C provide approximately 360 $ft.^2$ of unobstructed floor space and only weigh approximately 218 lbs. Embodiments of the shelter 27 shown in FIG. 1D, which is preferably formed of a pair of identical, end-joined halves, provide, with each half, approximately 385 $ft.^2$ of unobstructed floor space and only weigh approximately 220 lbs. Accordingly, it can be seen that the shelters according to the present invention provide great amounts of unobstructed floor space at a minimal weight.

The shelters 21, 23, 25, and 27 are generally cylindrical in shape, when erected, and have open ends. The ends of the shelters 21, 23, 25, and 27 may be closed off with suitable coverings, preferably including doorways, or the shelters may be combined with one another, such as by being joined together at ends or sides of one another with means such as zipper fasteners or VELCRO TM hook and loop fasteners attached to the covers 37 and 37, to form larger shelters for purposes such as mobile hospitals. Moreover, the shelters 21, 23, 25, and 27 may be combined in a similar fashion with other shelters, such as the shelters disclosed in U.S. Pat. No. Re. 33,910, which is incorporated by reference.

As noted above, the shelters 21, 23, 25, and 27 are all preferably formed from one or more of three types of modules 41, 43, and 45. The ability to form a wide variety of shelter types with those three basic types of modules 41, 43, and 45 facilitates manufacturing in that it is not necessary to construct a wide variety of different module types to produce the wide variety of shelters and the same-sized horizontal edges of the individual modules are joined to one another by shared hub assemblies. Of course, if customization of the shelters is desired, it is understood that modules in accordance with the present invention other than the 0° module 41, the 30° module 43, and the 60° module may be produced as well, such as modules similar to the cylindrical and spherical modules disclosed in U.S. Pat. No. 5,230,196, or modules similar to the transition modules disclosed in U.S. Pat. No. Re. 33,710, both of which are incorporated by reference.

It is, of course, possible to embody the invention in specific forms other than those described above without departing from the spirit of the present invention. The embodiments described above are merely illustrative and should not be considered restrictive in any way. The scope of the invention is given in the appended claims, rather than the preceding description, and all variations and equivalents which fall within the range of the claims are intended to be embraced therein.

What is claimed is:

1. An expandable and collapsible scissor assembly for an expandable and collapsible structure, comprising:

a first strut having a first and a second end;

a second strut having a first and a second end;

means for limiting the first and second ends of the first and second struts to movement in a substantially common plane, the first and second struts overlying each other at a point in the plane;

first means for preventing movement of the first end of the first strut away from the second end of the second strut beyond a first expanded distance;

releasable means for releasably preventing movement of the second end of the first strut away from the first end of the second strut beyond a second expanded distance, the releasable means being releasable to permit movement of the second end of the first strut away from the first end of the second strut beyond the second expanded distance;

first means for locking the first end of the first strut in a spaced relationship with the first end of the second strut;

second means for locking the second end of the first strut in a spaced relationship with the second end of the second strut.

2. The scissor assembly as set forth in claim 1, wherein, when the releasable means is released and the first and second locking means are unlocked, the first strut is pivotable relative to the second strut through substantially 180°.

3. The scissor assembly as set forth in claim 1, wherein, when the releasable means is released and the first and second locking means are unlocked, the first and second struts are pivotable relative to each other between a first position in which the first end of the first strut and the second end of the second strut are substantially adjacent and a second position in which the first end of the first strut and the first end of the second strut are substantially adjacent.

4. The scissor assembly as set forth in claim 1, wherein, when the releasable means is released and the first and second locking means are unlocked, the first and second struts are pivotable relative to each other between two substantially parallel relationships.

5. The scissor assembly as set forth in claim 1, wherein the releasable means includes a first cable adapted to be arranged in tension between the first end of the second strut and the second end of the first strut.

6. The scissor assembly as set forth in claim 5, further comprising cable keeper means for holding the first cable in a desired position when the scissor assembly is collapsed.

7. The scissor assembly as set forth in claim 6, wherein the cable keeper means includes a second cable arranged between the first end of the first strut and the second end of the second strut, the second cable being wrapped around the first cable.

8. The scissor assembly as set forth in claim 5, further comprising movable securing means for releasably securing a first end of the first cable to a point proximate the second end of the first strut.

9. The scissor assembly as set forth in claim 8, wherein the securing means includes a collar slidably disposed on the first strut and means for securing the collar at the point proximate the second end of the first strut.

10. The scissor assembly as set forth in claim 9, wherein the securing means includes a retractable button and means for urging the retractable button radially out of the first strut.

11. The scissor assembly as set forth in claim 10, wherein the urging means includes a plate spring disposed inside the first strut.

12. The scissor assembly as set forth in claim 10, further comprising second movable securing means for releasably securing a second end of the first cable to a point proximate the first end of the second strut.

13. The scissor assembly as set forth in claim 1, further comprising means for pivotably pinning the first and second strut to one another.

14. The scissor assembly as set forth in claim 1, wherein the first locking means includes a first hub assembly including a first outer portion and a first inner portion, the first outer portion and the first inner portion being engageable and disengageable, the first end of the first strut being pivotably attached to the first outer portion, the first end of the second strut being pivotably attached to the first inner portion, and the second locking means includes a second hub assembly including a second outer portion and a second inner portion, the second outer portion and the second inner portion being engageable and disengageable, the second end of the first strut being pivotably attached to the second inner portion, the second end of the second strut being pivotably attached to the second outer portion.

15. The scissor assembly as set forth in claim 14, wherein the first hub assembly and its component outer and inner hub assemblies are substantially identical to the second hub assembly and its component outer and inner hub assemblies, respectively, and, for each of the first and second hub assemblies, one of the inner and outer hub assemblies includes a male portion including, at a leading end thereof, two or more retractable pinning members, the male portion further including means for urging the retractable pinning members radially out of the male portion, and the other one of the inner and outer hub assemblies includes a female portion for receiving the male portion, the female portion including apertures for receiving the retractable pinning members to secure the inner and outer hub assemblies in an engaged condition.

16. The scissor assembly as set forth in claim 15, wherein the retractable pinning members include a pair of button portions and the retractable pinning member urging means includes a spring.

17. The scissor assembly as set forth in claim 16, wherein the retractable pinning members are in the form of a pair of blades, each of the blades having first ends on which one of the pair of button portions is mounted and each of the blades having second ends mounted on a common pivot.

18. The scissor assembly as set forth in claim 17, wherein the spring is a torsion spring mounted on the pivot and arranged to urge the first ends of the pair of blades apart.

19. The scissor assembly as set forth in claim 17, wherein the one of the outer and inner hub assemblies having the male portion includes a cavity for receiving a second end of the male portion and means for fixing the male portion in the cavity.

20. The scissor assembly as set forth in claim 19, wherein the fixing means includes the pivot.

21. The scissor assembly as set forth in claim 20, wherein the pivot includes a collar on which the second ends of the blades are mounted and a pin received in an opening in the collar and an opening in the one of the outer and inner hub assemblies having the male portion for fixing the male portion in the cavity.

22. The scissor assembly as set forth in claim 14, further comprising a cover and means for holding the cover in position relative to a selected hub assembly of at least one of the first and second hub assemblies, the cover holding means including a cover holder, the cover holder including a flange and a male portion extending, at a first end, from the flange, the male portion including a second end having a flared end portion extending substantially radially outward from the male portion, the cover holding means further including a hub, the hub forming a part of the selected one of the hub assemblies, the hub including an axial opening in which the second end of the male portion is receivable, the axial opening being provided with one or more internal flanges extending radially inwardly for retaining the cover holder by the flared portion when the cover holder is axially turned relative to the axial opening.

23. The scissor assembly as set forth in claim 22, wherein the cover holder is secured to the cover.

24. The scissor assembly as set forth in claim 1, wherein the first and second struts overlie one another substantially at mid-points of the first and second struts.

25. The scissor assembly as set forth in claim 1, wherein the first and second struts overlie one another at an intersection point such that distances between the intersection point and the first end of the second strut and between the intersection point and the second end of the first strut, respectively, are substantially equal, and distances between the intersection point and the first end of the first strut and between the intersection point and the second end of the second strut, respectively, are substantially equal.

26. The scissor assembly as set forth in claim 1, wherein, when the first end of the first strut and the second end of the second strut are at the first expandable distance and the first end of the second strut and the second end of the first strut are at the second expandable distance, a line extending through the first end of the first strut and the first end of the second strut forms an angle with a line extending through the second end of the first strut and the second end of the second strut.

27. An expandable and collapsible structural module, comprising:

four interconnected strut pairs, each strut pair including a first strut, the first strut having a first and a second end, and a second strut, the second strut having a first and a second end, the first end of the first strut of each strut pair being pivotably attached at an outer corner of the module to a second end of a second strut of a preceding strut pair, the first end of the second strut of each strut pair being pivotably attached at an inner corner of the module to a second end of a first strut of a preceding strut pair, the strut pairs being interconnected such that first and second struts of each one of the strut pairs overlie each other in a plane defined by each strut pair, the four interconnected strut pairs including a first, a second, a third, and a fourth strut pair arranged consecutively, end to end, the first, second, third, and fourth strut pairs, respectively, preceding the second, third, fourth, and first strut pairs, respectively, and succeeding the fourth, first, second, and third strut pairs, respectively;

first means for preventing movement of the first ends of the first struts away from the second ends of the second struts beyond a first expanded distance;

releasable means for releasably preventing movement of the second ends of the first struts of the first and third strut pairs away from the first ends of the second struts of the first and third strut pairs beyond a second expanded distance, the releasable means being releasable to permit movement of the second ends of the first struts of the first and third strut pairs away from the first ends of the second struts of the first and third strut pairs beyond the second expanded distance;

second means for preventing movement of the second ends of the first struts of the second and fourth strut pairs away from the first ends of the second struts of the second and fourth strut pairs beyond a third expanded distance; and means for locking the outer corners in a spaced relationship with corresponding ones of the inner corners.

28. The structural module as set forth in claim 27, wherein the second movement preventing means includes means for pivotably pinning the first and second struts of the second and fourth strut pairs.

29. The structural module as set forth in claim 27, wherein the second movement preventing means includes a first cable arranged between the second end of the first strut and the first end of the second strut of the second strut pair and a second cable arranged between the second end of the first strut and the first end of the second strut of the fourth strut pair.

30. The structural module as set forth in claim 27, wherein the first movement preventing means includes a pair of cables, each cable being arranged between a different pair of non-consecutive ones of the outer corners.

31. The structural module as set forth in claim 27, wherein the first movement preventing means includes a first cable arranged between the first end of the first strut and the second end of the second strut of the first strut pair and a second cable arranged between the first end of the first strut and the second end of the second strut of the third strut pair.

32. The structural module as set forth in claim 27, wherein the releasable movement preventing means includes a first scissor cable adapted to be arranged between the first end of the second strut and the second end of the first strut of the first strut pair and a second scissor cable adapted to be arranged between the first end of the second strut and the second end of the first strut of the third strut pair.

33. The structural module as set forth in claim 27, wherein, when the structural module is in an expanded condition, the first and second struts of at least the second and fourth strut pairs overlie one another substantially at mid-points of the first and second struts.

34. The structural module as set forth in claim 27, wherein, when the module is in the expanded condition, for each strut pair, the first and second struts overlie one another at an intersection point such that distances between the intersection point and the first end of the second strut and between the intersection point and the second end of the first strut, respectively, are substantially equal, and distances between the intersection point and the first end of the first strut and between the intersection point and the second end of the second strut, respectively, are substantially equal.

35. The structural module as set forth in claim 27, wherein, when the module is in its expanded condition, a plane defined by the second strut pair is non-parallel to a plane defined by the fourth strut pair.

36. An expandable and collapsible shelter, comprising:

a series of interconnected, expandable and collapsible structural modules, each structural module including four interconnected strut pairs, each strut pair including a first strut, the first strut having a first and a second end, and a second strut, the second strut having a first and a second end, the first end of the first strut of each strut pair being pivotably attached at an outer corner of the module to a second end of a second strut of a preceding strut pair, the first end of the second strut of each strut pair being pivotably attached at an inner corner of the module to a second end of a first strut of a preceding strut pair, the strut pairs being interconnected such that first and second struts of each one of the strut pairs overlie each other in a plane defined by each strut pair, the four interconnected strut pairs including a first, a second, a third, and a fourth strut pair arranged consecutively, end to end, the first, second, third, and fourth strut pairs, respectively, preceding the second, third, fourth, and first strut pairs, respectively, and succeeding the fourth, first, second, and third strut pairs, respectively, first means for preventing movement of the first ends of the first struts away from the second ends of the second struts beyond a first expanded distance, second means for preventing movement of the second ends of the first struts of the first and third strut pairs away from the first ends of the second struts of the first and third strut pairs beyond a second expanded distance, third means for preventing movement of the second ends of the first struts of the second and fourth strut pairs away from the first ends of the second struts of the second and fourth strut pairs beyond a third expanded distance, and means for locking the outer corners in a spaced relationship with corresponding ones of the inner corners, wherein, for at least one of interconnected modules, the second movement preventing means is releasable, the releasable second movement preventing means being releasable to permit movement of the second ends of the first struts of the first and third strut pairs away from the first ends of the second struts of the first and third strut pairs beyond the second expanded distance.

37. The expandable and collapsible shelter as set forth in claim 36, wherein the interconnected structural modules in their expanded conditions include first modules in which a plane defined by the first strut pair is non-parallel to a plane defined by the third strut pair.

38. The expandable and collapsible shelter as set forth in claim 37, wherein the interconnected structural modules in their expanded conditions include second modules in which a plane defined by the second strut pair is parallel to a plane defined by the fourth strut pair.

39. The expandable and collapsible shelter as set forth in claim 37, wherein the first modules include 30° modules in which an angle formed by the non-parallel planes is substantially 30°.

40. The expandable and collapsible shelter as set forth in claim 37, wherein the first modules include 60° modules in which an angle formed by the non-parallel planes is substantially 60°.

* * * * *